US012729630B2

(12) United States Patent
Hoyt et al.

(10) Patent No.: US 12,729,630 B2
(45) Date of Patent: Sep. 8, 2026

(54) VARIABLE VANE LEVER ARM

(71) Applicant: RTX Corporation, Farmington, CT (US)

(72) Inventors: Samuel B. Hoyt, Farmington, CT (US); Fadi Samir Maalouf, East Hampton, CT (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 19/041,827

(22) Filed: Jan. 30, 2025

(65) Prior Publication Data

US 2026/0218623 A1 Jul. 30, 2026

(51) Int. Cl.
*F01D 17/16* (2006.01)

(52) U.S. Cl.
CPC ..... *F01D 17/162* (2013.01)

(58) Field of Classification Search
CPC ..... F01D 17/162; F01D 9/041; F04D 29/563
See application file for complete search history.

(56) References Cited

U.S. PATENT DOCUMENTS

| | | | | |
|---|---|---|---|---|
| 7,223,066 | B2 * | 5/2007 | Rockley | F04D 27/0246 415/209.3 |
| 7,344,355 | B2 | 3/2008 | Wilshaw | |
| 9,988,926 | B2 | 6/2018 | Gasmen et al. | |
| 10,018,069 | B2 | 7/2018 | Osborne et al. | |
| 10,590,795 | B2 | 3/2020 | Pratt et al. | |
| 10,830,090 | B2 | 11/2020 | Mairhanser | |
| 10,837,309 | B2 | 11/2020 | Pratt et al. | |
| 2016/0032759 | A1 * | 2/2016 | Gasmen | F01D 17/162 409/131 |
| 2018/0163560 | A1 * | 6/2018 | Mairhanser | F01D 17/162 |
| 2022/0341342 | A1 * | 10/2022 | Nauss | F02C 9/22 |

* cited by examiner

*Primary Examiner* — Michael K. Reitz
(74) *Attorney, Agent, or Firm* — Bachman & LaPointe, P.C.

(57) ABSTRACT

A vane arm has: a first end and a second end; a shank extending between the first end and the second end and having a first face and a second face; a first hole in the shank proximate the first end; a second hole in the shank proximate the second end; and a transverse groove in the first face intersecting the second hole. The transverse groove has: a base; a first open end and a second open end; a first side face and a second side face. The transverse groove first side face and second side face converge toward each other from the first open end to the second open end.

20 Claims, 11 Drawing Sheets

VARIABLE VANE LEVER ARM

BACKGROUND

The disclosure relates to variable lever arms. More particularly, the disclosure relates to vane lever arms such as used for variable vanes of a gas turbine engine.

Gas turbine engines (used in propulsion and power applications and broadly inclusive of turbojets, turboprops, turbofans, turboshafts, industrial gas turbines, and the like) may include variable vane stages in one or more sections of the engine. In a variable vane stage, a circumferential array of vane airfoils are each rotatable about the respective associated axis of rotation. The vane airfoils may each be mounted for such a rotation to an inner diameter (ID) platform/shroud or inner casing and an outer diameter (OD) shroud or outer casing. Vane rotation may be driven by respective lever arms typically mounted to an outer diameter (OD) shaft of the vane.

Example vane lever arms extend between a driving end and a driven end. The driving end includes one or more features for mounting to a driver such as a synchronizing ring. The driven end includes one or more features for mounting to the associated vane OD shaft/stem to rotate said vane about its axis of rotation.

A number of constructions of vane arms exist. U.S. Pat. No. 9,988,926B2 (the '926 patent) of Gasmen et al., Jun. 5, 2018, and entitled "Machined Vane Arm of a Variable Vane Actuation System" discloses a machined vane arm. The disclosure of the '926 patent is incorporated by reference herein in its entirety as if set forth at length. The driving end has a hole/aperture for accommodating a drive pin engaged by the synchronizing ring. The driven end of the arm has a transverse groove intersecting the vane-mounting hole. The groove receives a complementary land of the vane from which a more distal portion of the stem protrudes. The groove has a base and angled side surfaces. The land has a complementary top end and side surfaces. Engagement of the groove and land side surfaces provides driving coupling.

SUMMARY

One aspect of the disclosure involves a vane arm comprising: a first end and a second end; a shank extending between the first end and the second end and having a first face and a second face; a first hole in the shank proximate the first end; a second hole in the shank proximate the second end; and a transverse groove in the first face intersecting the second hole. The transverse groove has: a base; a first open end and a second open end; a first side face and a second face. The transverse groove first side face and second side face converge toward each other from the first open end to the second open end.

In a further embodiment of any of the foregoing embodiments, additionally and/or alternatively, the transverse groove first side face and second side face converge toward each other from the first open end to the second open end at an angle ($\theta$) of 15° to 35° over at least 50% of a length ($L_G$) of the transverse groove.

In a further embodiment of any of the foregoing embodiments, additionally and/or alternatively, the angle is 20° to 30° over at least 50% of the length of the transverse groove.

In a further embodiment of any of the foregoing embodiments, additionally and/or alternatively, the transverse groove first side face and second side face diverge from an axial direction of the second hole in a direction from the base to the first face at an angle ($\gamma$) of 40° to 60° over at least 50% of the length of the transverse groove and at least 50% of the depth of the transverse groove.

In a further embodiment of any of the foregoing embodiments, additionally and/or alternatively: an average depth of the transverse groove is at least 2.0 mm; a distance between centers of the first and second holes is 25 millimeters to 51 millimeters; and an overall length of the vane arm is no more than 80 millimeters.

In a further embodiment of any of the foregoing embodiments, additionally and/or alternatively, the transverse groove first side face and second side face are, over a majority of their respective areas, planar facets.

A further embodiment of any of the foregoing embodiments may additionally and/or alternatively include a third hole between the first hole and the second hole and closer to the second hole.

A further embodiment of any of the foregoing embodiments may additionally and/or alternatively include the vane arm being machined from a nickel-alloy.

A further aspect of the disclosure involves a vane assembly including the vane arm and further comprising a vane having an airfoil and a shaft protruding from an end of the airfoil, wherein: the vane shaft extends through the second hole; the vane shaft has first and second faces respectively abutting the transverse groove first side face and second side face; and a nut holds the vane arm to the shaft.

In a further embodiment of any of the foregoing embodiments, additionally and/or alternatively, the vane shaft first and second faces and the transverse groove first side face and second side face are configured to prevent assembly with the vane arm in an orientation 180° about an axis of the shaft.

A further embodiment of any of the foregoing embodiments may additionally and/or alternatively include a pin mounted in and protruding from the first hole.

A further aspect of the disclosure involves a vane stage comprising a plurality of said vane assemblies, and further comprising: a synchronizing ring coupled to the vane arms and having an axis; and for each vane assembly one or more bearings mounting the vane for rotation about an axis of the vane wherein, rotation of the synchronizing ring about its axis rotates the vanes about their respective axes.

A further aspect of the disclosure involves a method for using the vane arm, the method comprising: installing the arm to a vane so that: a shaft of the vane extending from an end of an airfoil of the vane passes through the second hole; A nut is installed to a threaded portion of the shaft to hold the vane arm to the shaft compressed between the nut and a shoulder of the shaft.

A further embodiment of any of the foregoing embodiments may additionally and/or alternatively include installing a pin to the first hole.

In a further embodiment of any of the foregoing embodiments, additionally and/or alternatively, the method is performed with a plurality of vane arms and the respective pins are mounted to a shared synchronizing ring.

A further aspect of the disclosure involves a vane arm comprising: a first end and a second end; a shank extending between the first end and the second end and having a first face and a second face; a first hole in the shank proximate the first end; a second hole in the shank proximate the second end; and a transverse groove in the first face intersecting the second hole. The groove has: a base; a first open end and a second open end; a first side face and a second side face. The groove first side face and second side face provide means for uniquely angularly registering the vane arm to a shaft.

A further aspect of the disclosure involves a vane assembly comprising a vane having an airfoil and a shaft protruding from an end of the airfoil. The shaft has: a threaded portion; a shoulder; and a first facet and a second facet between the shoulder and the threaded portion. The assembly further includes a vane arm having: a first end and a second end; a shank extending between the first end and the second end and having a first face and a second face; a first hole in the shank proximate the first end; a second hole in the shank proximate the second end, the shaft in the second hole; a groove intersecting the second hole. The transverse groove has: a base; a first sidewall contacting the first facet; and a second sidewall contacting the second facet. A nut holds the vane arm to the shaft compressed between the nut and the shoulder. In cross-section normal to an axis of the threads of the threaded portion, the first and second facets are off-parallel to each other.

In a further embodiment of any of the foregoing embodiments, additionally and/or alternatively, in said cross-section normal to the axis of the threads of the threaded portion, the first and second facets are off-parallel to each other by an angle (θ) of 15° to 35°.

In a further embodiment of any of the foregoing embodiments, additionally and/or alternatively, a tab washer is between the nut and the vane arm and has a tab received in a third hole between the first hole and the second hole.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
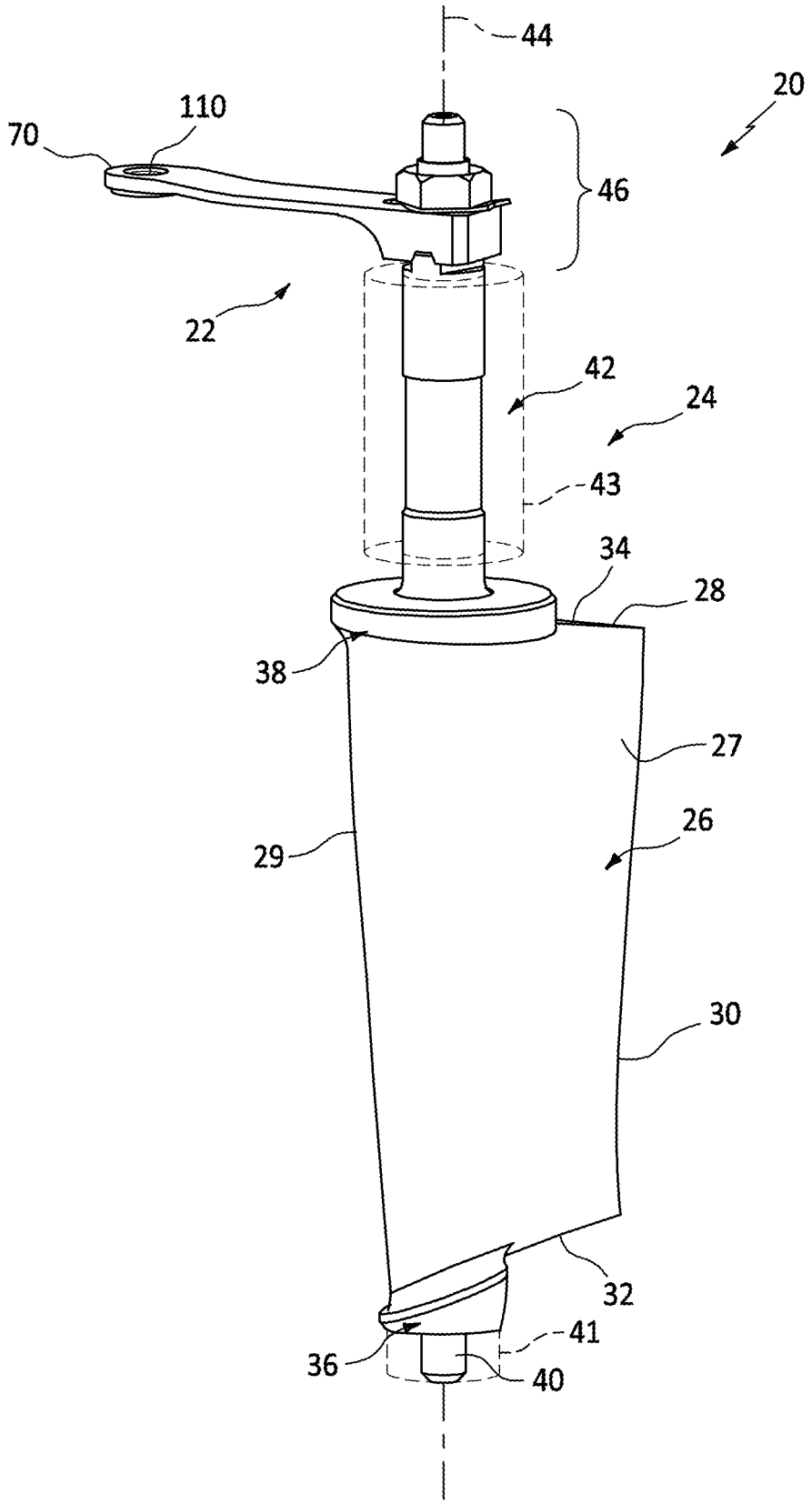
FIG. 1 is a view of a vane assembly.
Figure 4:
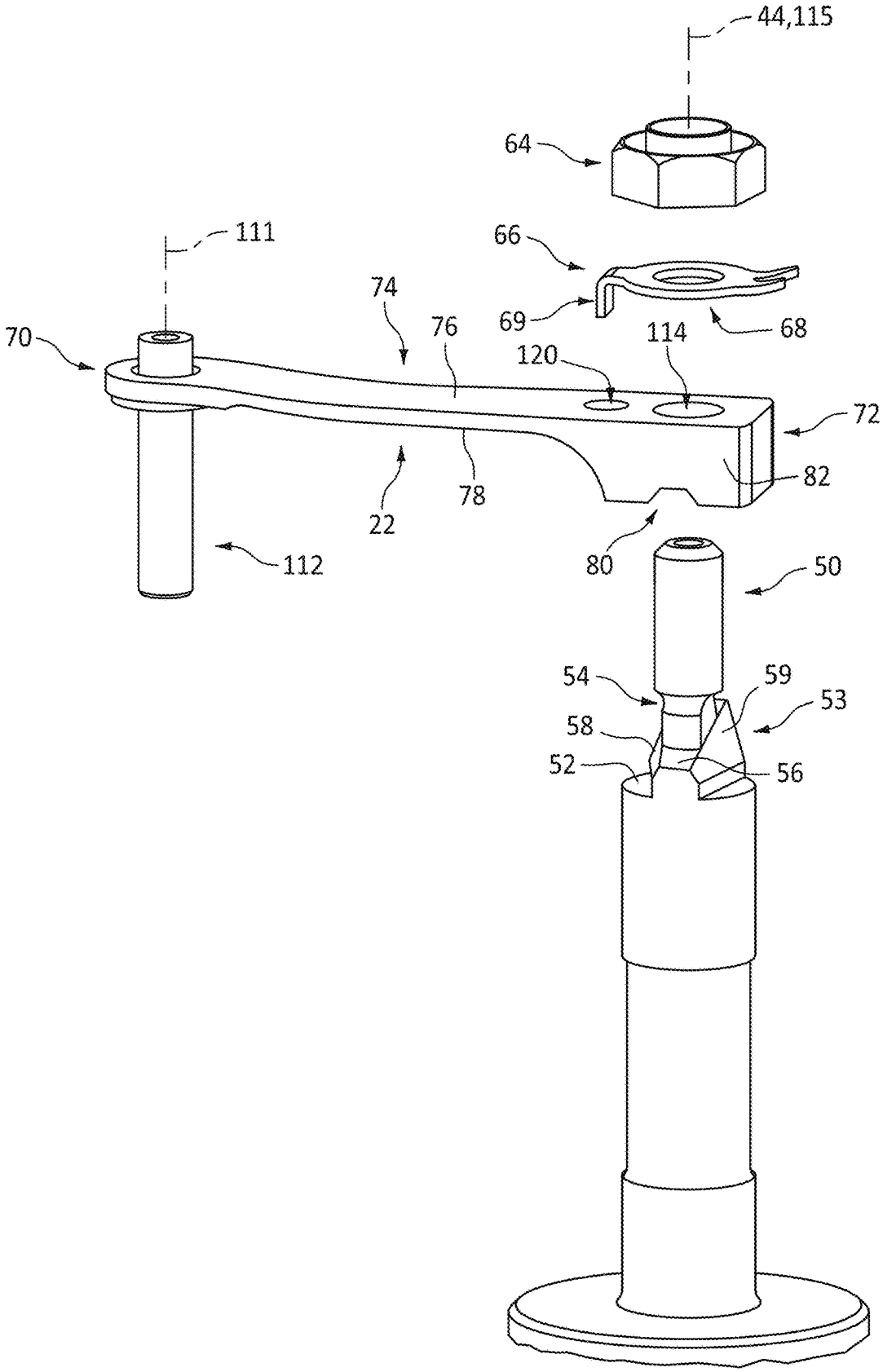
FIG. 4 is an exploded view of the vane arm region.
Figure 8:
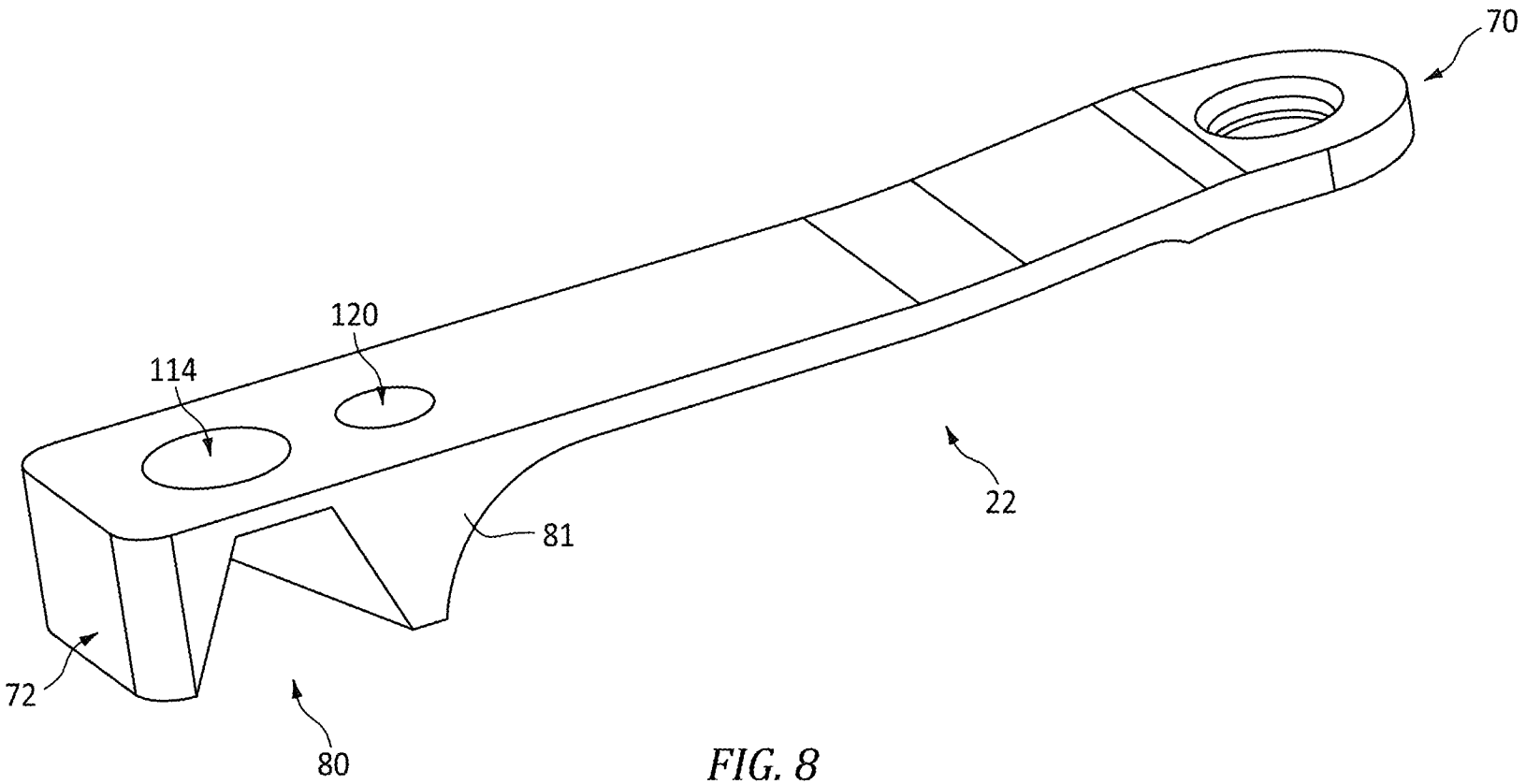
FIG. 8 is view of a vane arm of the assembly.

FIG. 1 shows a vane assembly 20 including vane arm 22 and vane 24 configured as a modification of the baseline of the '926 patent. The modification shifts the keying function from the driven end hole 114 to the transverse vane groove 80 (FIGS. 4&8). This keying is achieved by having a non-zero transverse angle between the groove sides (and, likewise between the vane ridge/land 53 (FIG. 4) sides). This is in distinction to a zero angle potentially allowing two alternative installation orientations 180° from each other. With keying provided by the groove and land, the keying function may be removed from the threaded portion of the shaft and the driven end hole. Thus, the driven end hole 114 may be circular in footprint and the shaft threads may be uninterrupted. FIG. 1 also schematically shows an ID bearing 41 and an OD bearing 43, respectively, engaging the shafts 40 and 42 mounting the vane for rotation about the axis 44.

The vane 24 includes an airfoil 26 having a pressure side 27, a suction side 28, a leading edge 29, and a trailing edge 30. The airfoil extends along a span from an inner diameter (ID) end 32 to an outer diameter (OD) end 34. Such ID and OD are measured essentially relative to the engine centerline. The airfoil ID and OD ends respectively merge, along forward/leading portions thereof, with respective ID and OD platforms 36 and 38. Respectively inward and outward from the platforms 36 and 38 are an ID shaft 40 and an OD shaft 42. The shafts are coaxial along a vane axis 44 which forms an axis of rotation and axis of threads of a threaded portion 50 discussed below. The OD shaft 42 includes a distal mounting section 46 for mating with the vane arm 22.

Figure 2:
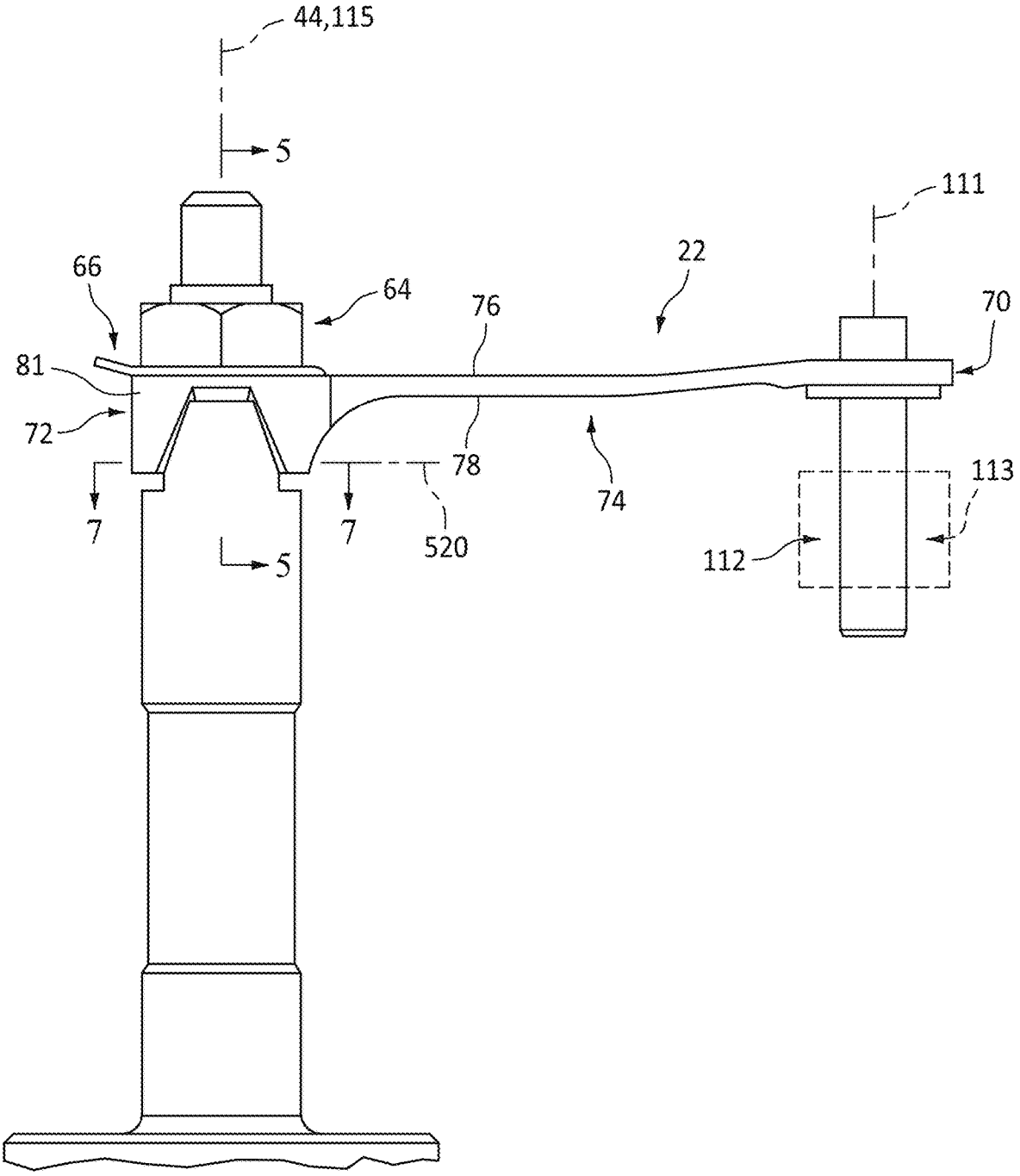
FIG. 2 is a first side view of the vane arm region.
Figure 3:
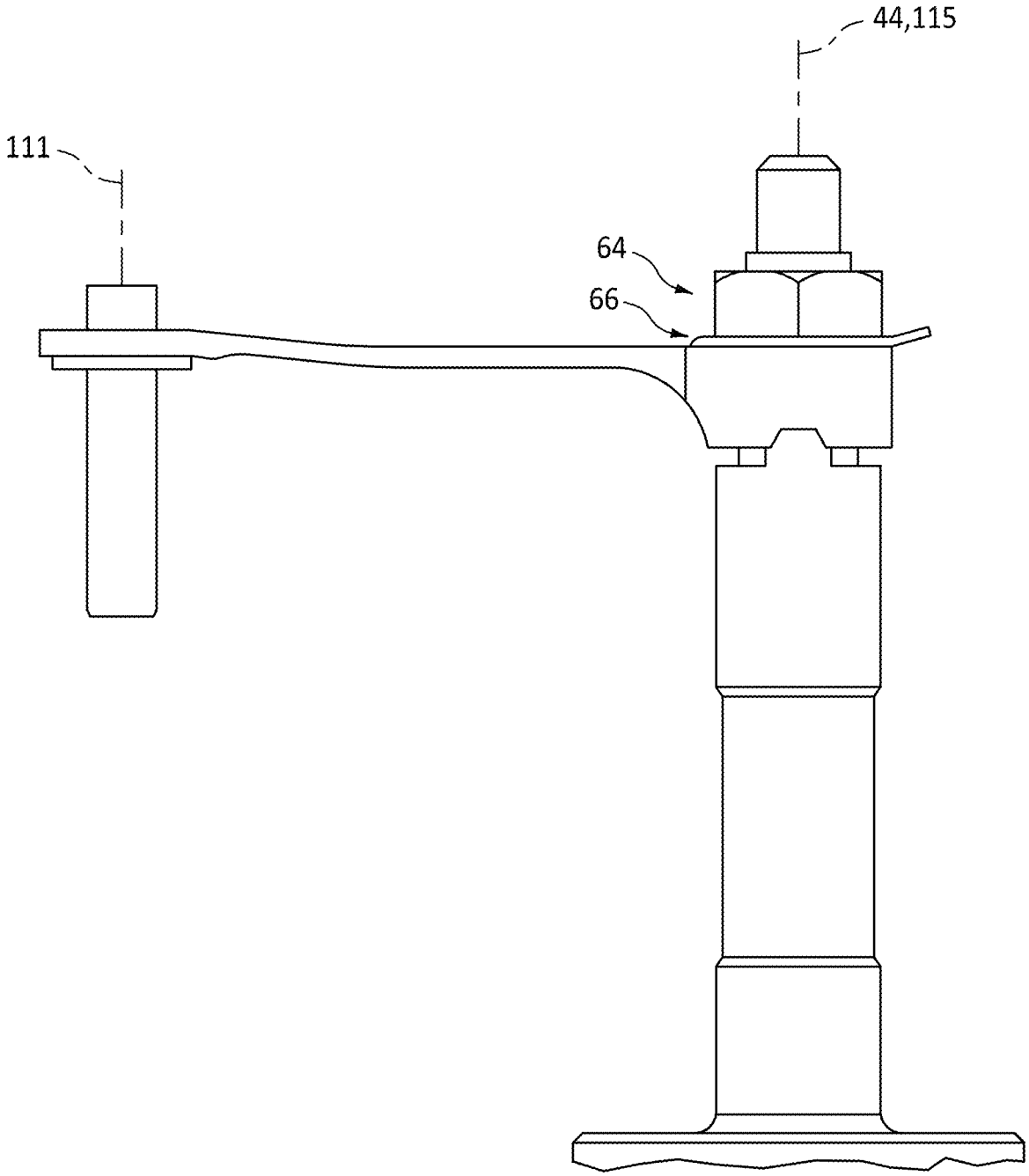
FIG. 3 is a second side view of the vane arm region.

The mounting section 46 includes an externally threaded section/region/portion 50 (FIG. 4) with a shoulder surface 52 radially inward thereof or proximal relative to the airfoil. The shoulder 52 is separated from the threaded section by transverse ridge or land 53 and then a necked region 54. The land 53 is a faceted section having opposed first and second lower 56, 57 and upper 58, 59 faces or facets. FIG. 2 also shows a nut 64 installed to the threaded section and a tab washer 66 between the nut and the arm. The tab washer has an annular body 68 (FIG. 4) and a tab 69 bent at an angle thereto.

The arm 22 (FIG. 2) extends generally from a first end 70 to a second end 72. In this example, the first end 70 is a driving end and the second end 72 is a driven end. The example arm 22 is formed from machined metal stock (e.g., nickel-based alloy/superalloy such as AMS 5596 or AMS 5662-UNS N07718). The arm 22 has a shank 74 extending between the first end and the second end and having a first face 76 and a second face 78. In an example method of manufacture, the arm 22 is machined from billet stock.

Figure 9:
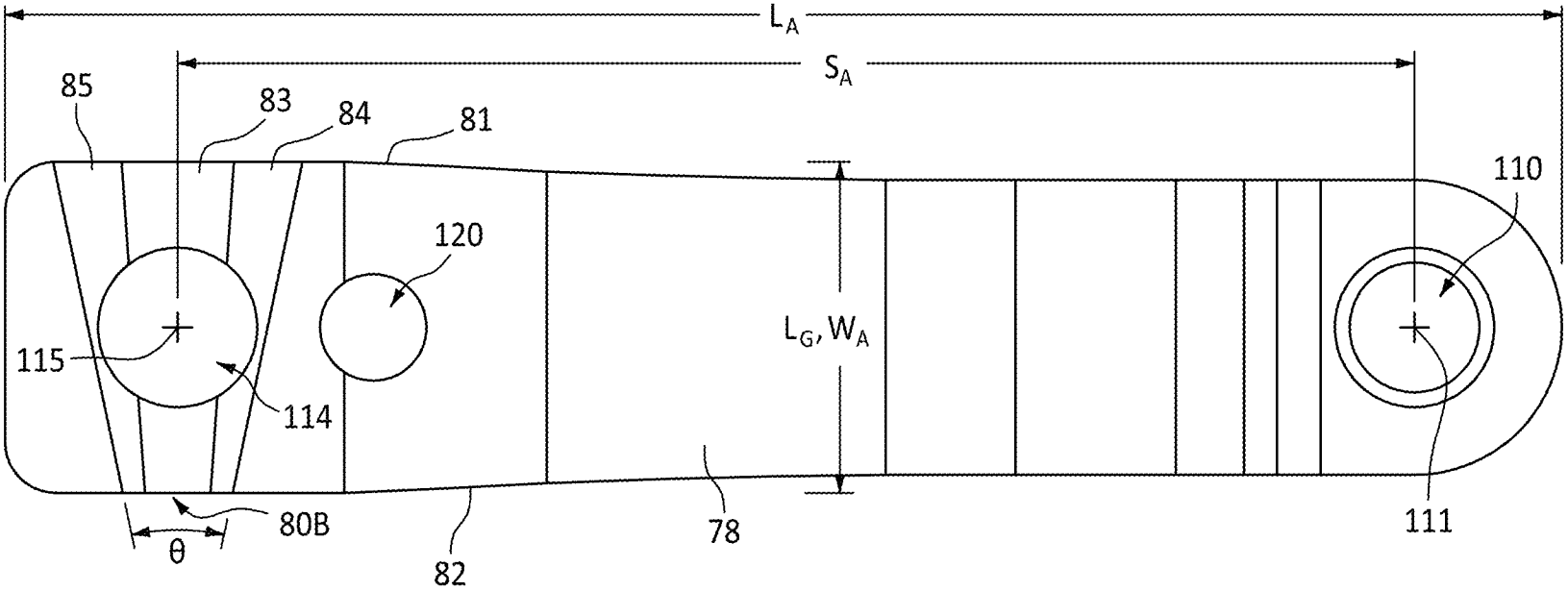
FIG. 9 is an inner diameter (ID) view of the vane arm.
Figure 10:
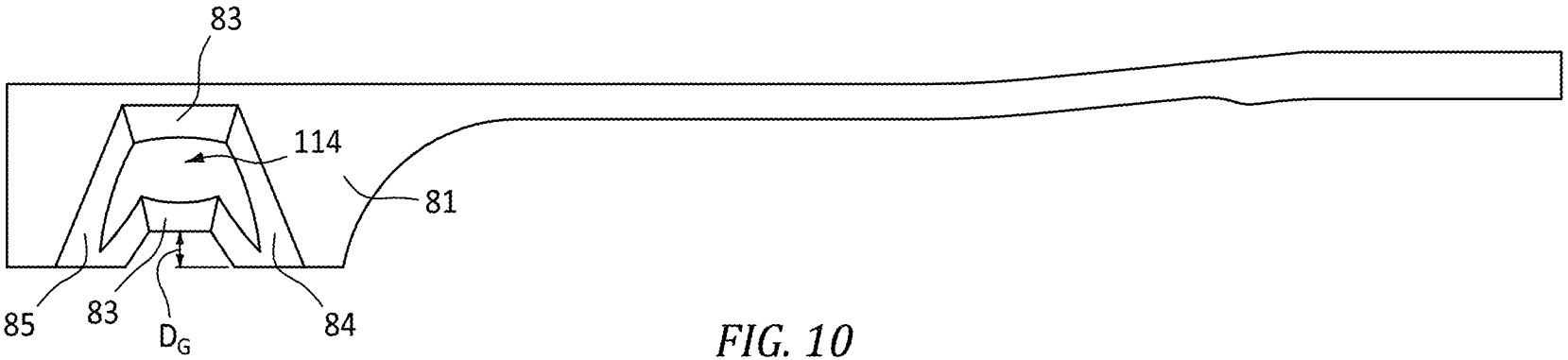
FIG. 10 is a first side view of the vane arm.
Figure 13:
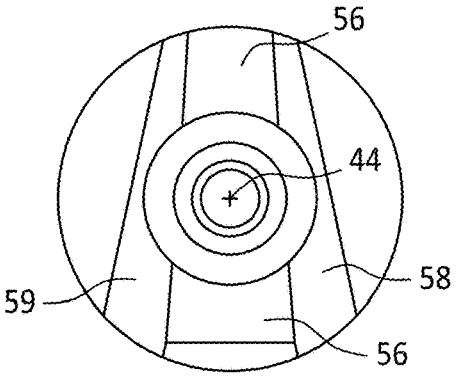
FIG. 13 is an outer diameter (OD) the OD shaft section.
Figure 11:
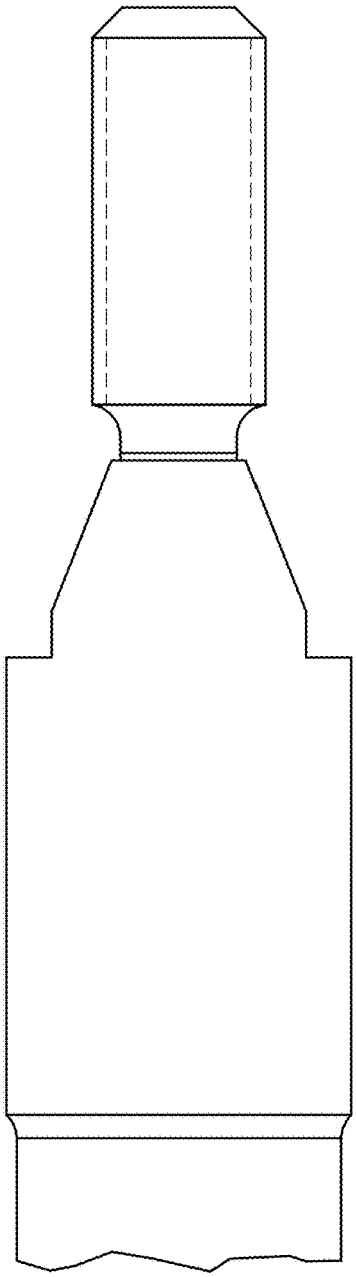
FIG. 11 is a first side view of an outer diameter (OD) shaft section of the vane of the assembly.
Figure 12:
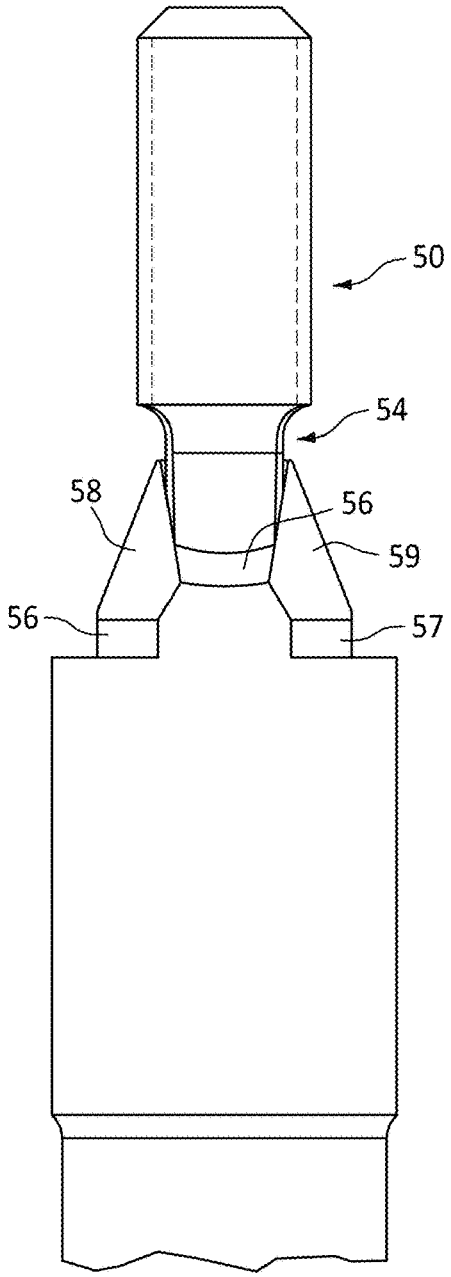
FIG. 12 is a second side view of the OD shaft section.

FIG. 4 shows the vane arm 22 having a transverse groove 80 extending between a first side face 81 (FIG. 9) and a second side face 82. The transverse groove 80 has a base surface 83 and side surfaces 84, 85. As is discussed further below, the surfaces 84 and 85 are shaped to respectively contact the facets 58 and 59 in an installed condition. An example groove depth DG at the deeper end (at side face 81) is about 0.19 inch (4.8 mm), more broadly 3.5 mm to 7.0 mm or 3.6 mm to 5.9 or 3.8 mm to 5.6 mm. An example groove depth DG at the shallow end (at side face 82) is 0.040 inch (1.0 mm), more broadly 0 mm to 3 mm) or an example up to half that at the deeper end. Example average depth at the base over the length of the groove (discounting hole intersection) is at least 2.0 mm.

Figure 1A:
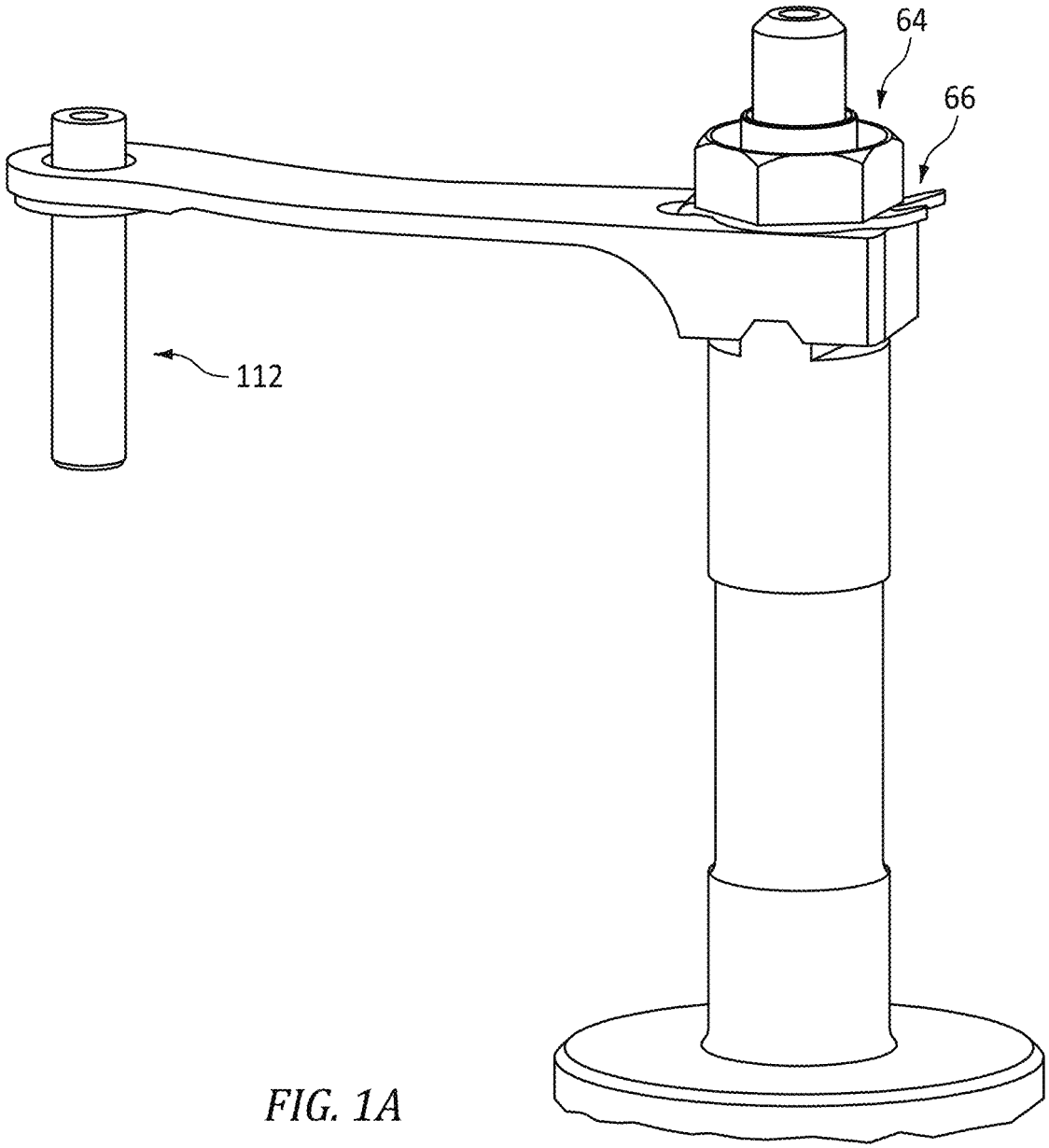
FIG. 1A is an enlarged view of a vane actuating arm region of the assembly of FIG. 1.

The example vane arm has exactly three through-holes. A first through-hole 110 (FIG. 9) is adjacent the first end 70 for receiving a driving pin 112 (FIGS. 1A&2) which, in turn, is mounted to a synchronizing ring 113 (FIG. 2) in common with the pins of the other vanes of the stage. A second through-hole 114 is near the second end and receives the OD shaft 42. The example second hole 114 is of circular cross-section dimensioned to just accommodate the threaded section 50. The hole 110 has an axis 111 shared with the pin 112. The second hole 114 has an axis 115 coaxial with the axis 44 in a mounted condition. An example hole-to hole distance or separation $S_A$ (FIG. 8) is about 1.5 inch (38 mm), more broadly 25 mm to 51 mm or 37 mm to 43 mm. An example overall length $L_A$ is about 1.7 inches (43 mm), more broadly 30 mm to 80 mm or 35 mm to 60 mm. Example arm width (also groove length) $W_A$ is about 0.4 inch (10 mm), more broadly 7 mm to 20 mm or 8 mm to 15 mm.

A third hole 120 (FIG. 9) is formed in the distal shank just to the first end side of the second hole 114 for receiving/accommodating the washer tab 69.

Figure 7:
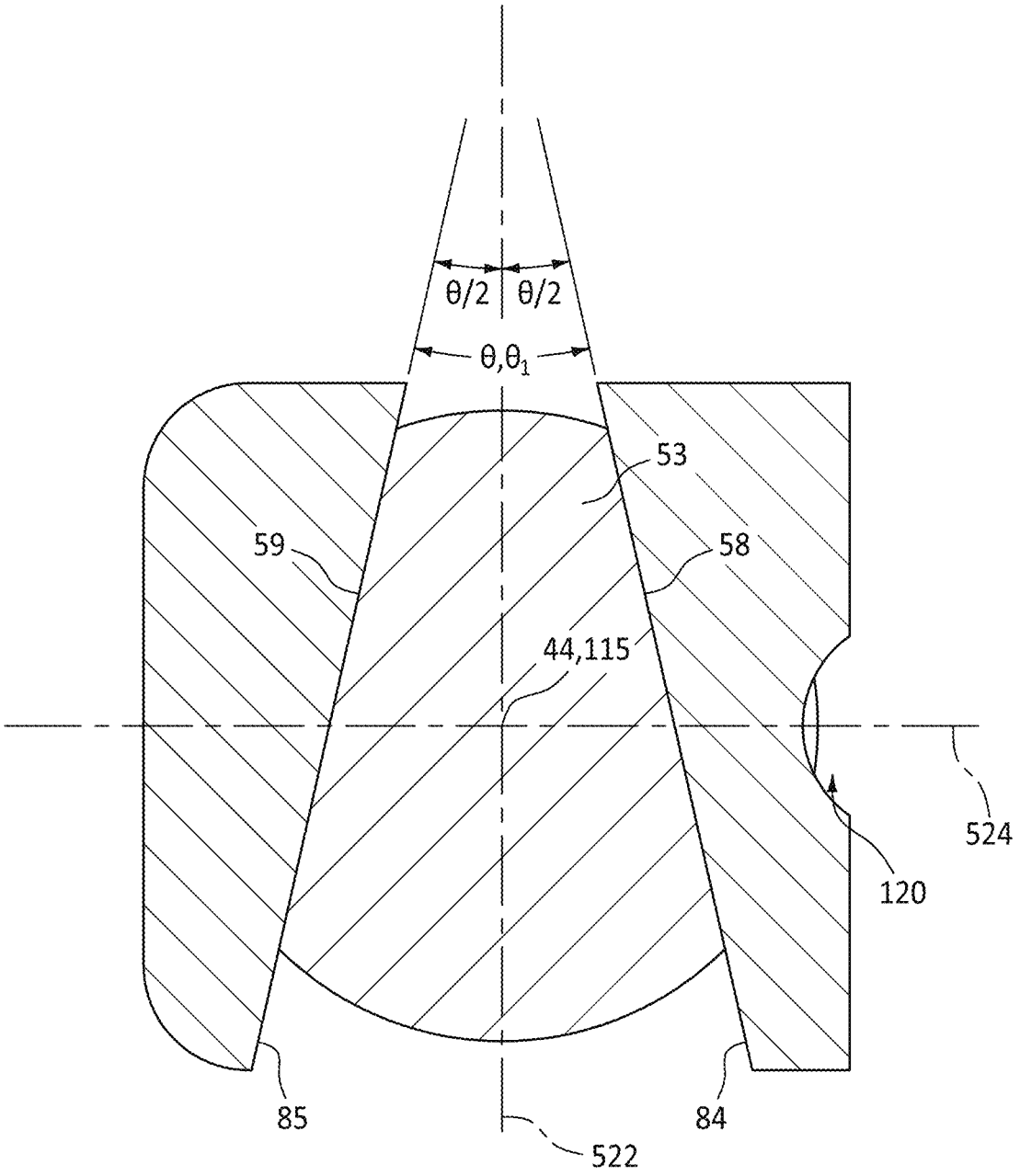
FIG. 7 is a transverse sectional view of the vane arm region taken along line 7-7 of FIG. 2.

The second hole 114 intersects the surfaces 83, 84, and 85. FIG. 7 shows the surfaces 84 and 85 converging toward each other from the groove open end at the surface 81 to the groove open end at the surface 82 at an angle θ viewed in a plane 520 transverse to the axis 115. Relative to a transverse plane 522 containing the axis 115, each surface is at an angle θ/2 in said plane 520.

Figure 5:
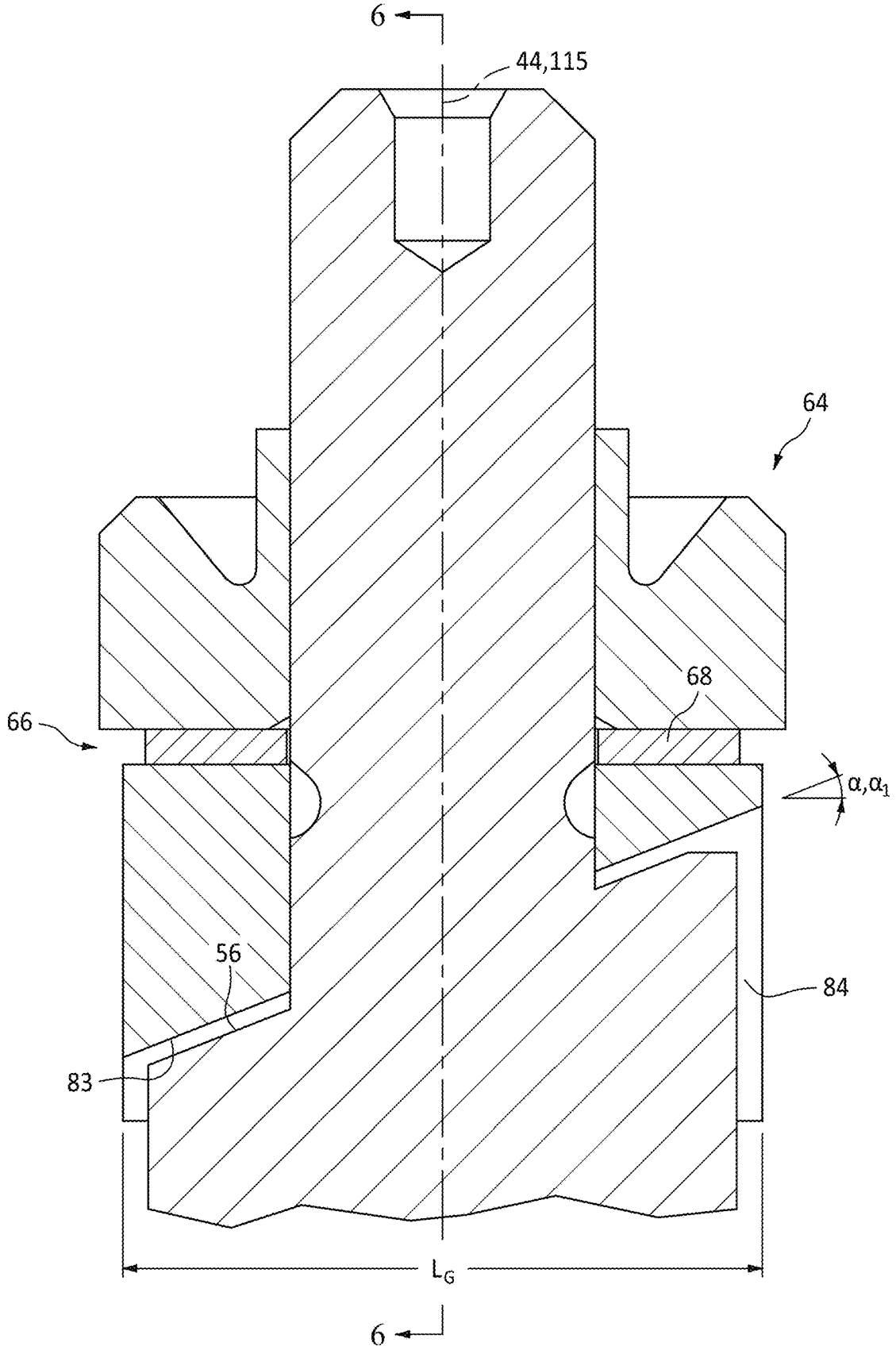
FIG. 5 is a sectional view of the vane arm region taken along line 5-5 of FIG. 2.

Additionally, FIG. 5 shows the surface 83 off-normal to the axis 115 by an angle α. In a similar fashion, the facets 58, 59 and peak 56 are similarly angled at angles $\theta_1$ and $\alpha_1$ which may be the same as θ and α, respectively.

This example θ is about 26°, more generally 25° to 27° or 20° to 30° or 15° to 35°. Example α is about 21°, more generally 19° to 23° or 15° to 25° or 10° to 30°. Such angle may exist over at least 50% of a length $L_G$ (FIG. 5) of the groove 80.

Figure 6:
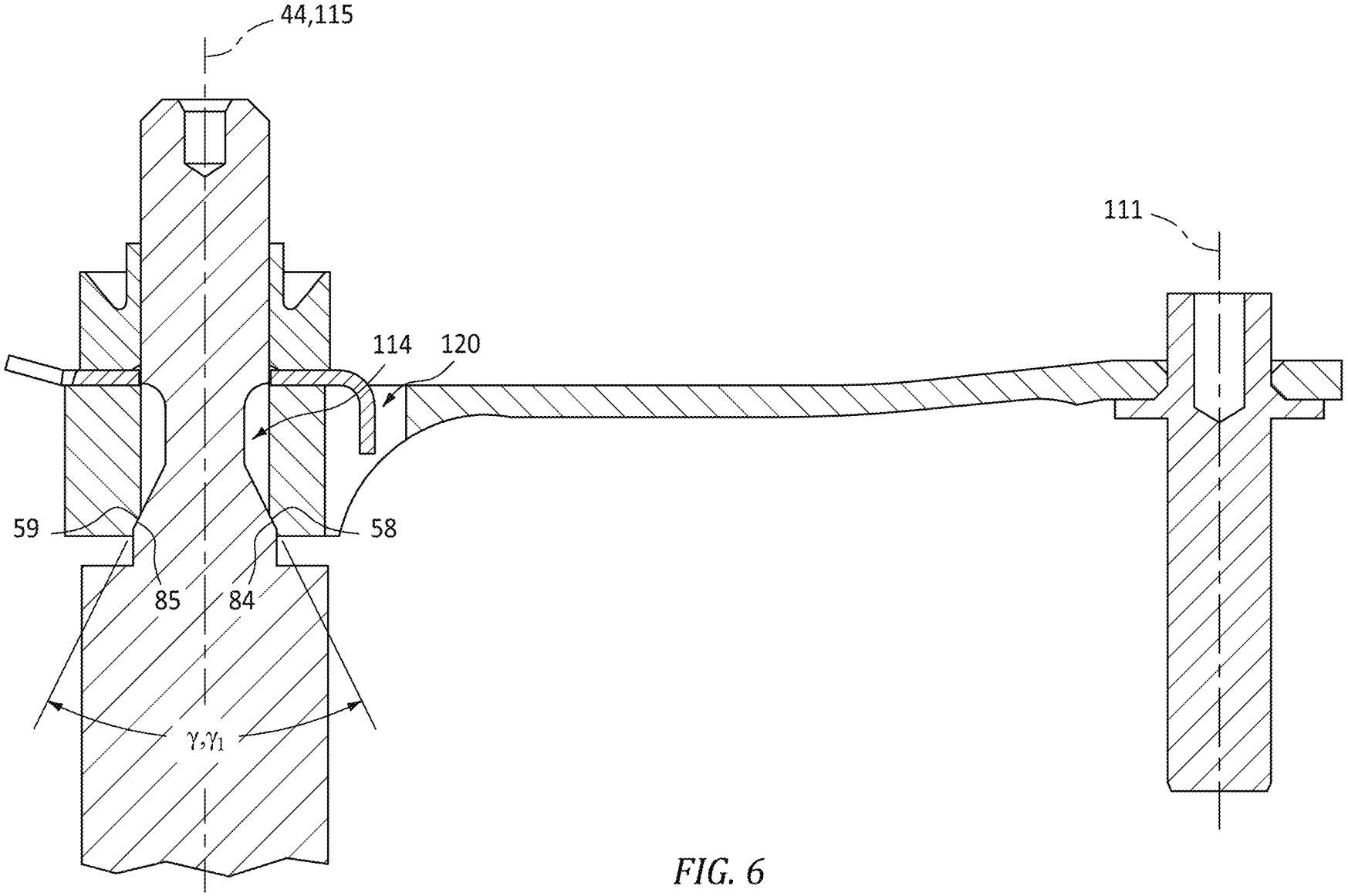
FIG. 6 is a sectional view of the vane arm region taken along line 6-6 of FIG. 5.

FIG. 6 shows divergence of the walls/facets from OD to ID in a longitudinal plane 524 (FIG. 7) at an angle γ for the groove and $\gamma_1$ for the ridge/land. Example γ and $\gamma_1$ are about 50°, more generally, 45° to 55° or 40° to 60°.

Any to all of these three pairs of angles may exist over the majorities of the contact areas at either or both sides or at least 90%.

In use, in a nominal installation situation the vane arm groove sides 84,85 would seat onto the facets/flats 58, 59 of the vane. The technician may install the pre-bent tab washer 66 with the pre-bent tab 69 inserting into the hole 120 the vane arm. The technician may then thread on the nut 64 and torque it onto the tab washer to finalize the assembly.

If non-nominal installation is attempted slightly biased to one side of angular registry about the axis 44, as the technician assembles the vane arm to the stem of the vane the flats would turn the vane stem to align with the vane arm and enable proper assembly.

In an extreme off-nominal assembly of 180° misregistry about the axis 44, as the technician slides the vane arm slides onto the stem of the vane the small end section of the vane arm groove would contact the wider end section of the stem ridge and prevent further assembly with clear visual indications that the arm was not seated properly. The delta between the two gap face sizes and heights in conjunction with the compound angle of the flats enables mistake proofing of the vane arm on to the vane stem.

The modification shifts the keying function from the driven end hole to the groove. This keying is achieved by having a non-zero transverse angle between the groove sides (and, likewise between the land sides) and the sloping groove base. With keying provided by the groove/land, the keying function may be removed from the threaded portion of the shaft and the driven end hole. Thus, the driven end hole may be circular in footprint and the shaft threads may be uninterrupted.

Relative to the baseline, such modification may offer one or more of several advantages. The driven end hole may be easier to form (e.g., drill). The step of grinding the shaft flat may be eliminated as may be any thread dressing or touch up required by pre-forming or post-forming the shaft flat. Keying may be improved, particularly with greater angles. Notably, whereas a parallel orientation of the groove and land sides would potentially offer two equivalent keying orientations, the angled configuration may limit to a single keying orientation.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

One or more embodiments have been described. Nevertheless, it will be understood that various modifications may be made. For example, when applied to an existing baseline configuration, details of such baseline may influence details of particular implementations. Accordingly, other embodiments are within the scope of the following claims.

What is claimed is:

1. A vane arm comprising:
a first end and a second end;
a shank extending between the first end and the second end and having a first face and a second face;
a first hole in the shank proximate the first end;
a second hole in the shank proximate the second end; and
a transverse groove in the first face intersecting the second hole and having:
a base;
a first open end and a second open end; and
a first side face and a second side face,
wherein:
the transverse groove first side face and second side face converge toward each other from the first open end to the second open end;
an average depth of the transverse groove is at least 2.0 mm;
a distance between centers of the first and second holes is 25 millimeters to 51 millimeters; and
an overall length of the vane arm is no more than 80 millimeters.

2. The vane arm of claim 1 wherein:
the transverse groove first side face and second side face converge toward each other from the first open end to the second open end at an angle (θ) of 15° to 35° over at least 50% of a length of the transverse groove.

3. The vane arm of claim 2 wherein:
the angle is 20° to 30° over at least 50% of the length of the transverse groove.

4. The vane arm of claim 1 wherein:
the transverse groove first side face and second side face diverge from each other a direction from the base to the first face at an angle (γ) of 40° to 60° over at least 50% of the length of the transverse groove and at least 50% of the depth of the transverse groove.

5. The vane arm of claim 1 wherein:
the transverse groove first side face and second side face are, over a majority of their respective areas, planar facets.

6. The vane arm of claim 1 further comprising:
a third hole between the first hole and the second hole and closer to the second hole.

7. The vane arm of claim 1 being machined from a nickel-alloy.

8. A vane assembly including the vane arm of claim 1 and further comprising a vane having an airfoil and a shaft protruding from an end of the airfoil, wherein:
the vane shaft extends through the second hole;

the vane shaft has first and second faces respectively abutting the transverse groove first side face and second side face; and a nut holds the vane arm to the shaft.

9. The vane assembly of claim 8, wherein:

the vane shaft first and second faces and the transverse groove first side face and second side face are configured to prevent assembly with the vane arm in an orientation 180° about an axis of the shaft.

10. The vane assembly of claim 9 further comprising:

a pin mounted in and protruding from the first hole.

11. A vane stage comprising a plurality of vane assemblies of claim 8, and further comprising:

a synchronizing ring coupled to the vane arms and having an axis; and for each vane assembly one or more bearings mounting the vane for rotation about an axis of the vane wherein, rotation of the synchronizing ring about its axis rotates the vanes about their respective axes.

12. A method for using the vane arm of claim 1, the method comprising:

installing the arm to a vane so that:

a shaft of the vane extending from an end of an airfoil of the vane passes through the second hole; and installing a nut to a threaded portion of the shaft to hold the vane arm to the shaft compressed between the nut and a shoulder of the shaft.

13. The method of claim 12 further comprising:

installing a pin to the first hole.

14. The method of claim 12 wherein:

the method is performed with a plurality of vane arms and the respective pins are mounted to a shared synchronizing ring.

15. A vane assembly comprising:

a vane having an airfoil and a shaft protruding from an end of the airfoil, the shaft having:

a threaded portion;

a shoulder; and a first facet and a second facet between the shoulder and the threaded portion;

a vane arm having:

a first end and a second end;

a shank extending between the first end and the second end and having a first face and a second face;

a first hole in the shank proximate the first end;

a second hole in the shank proximate the second end, the shaft in the second hole;

a transverse groove intersecting the second hole and having:

a base;

a first sidewall contacting the first facet; and a second sidewall contacting the second facet; and a nut holding the vane arm to the shaft compressed between the nut and the shoulder, wherein:

in cross-section normal to an axis of the threads of the threaded portion, the first and second facets are off-parallel to each other by an angle (θ) of 15° to 35°.

16. The vane assembly of claim 15 wherein:

the groove is transverse to said axis of the threads of the threaded portion; and a tab washer is between the nut and the vane arm and has a tab received in a third hole between the first hole and the second hole.

17. The vane assembly of claim 15 wherein:

the vane arm has a first side face and a second side face;

the first side face and the second side face are opposite from each other about the axis of the threads of the threaded portion; and the transverse groove has respective open ends at the first side face and second side face.

18. A vane arm comprising:

a first end and a second end;

a shank extending between the first end and the second end and having a first face and a second face;

a first hole in the shank proximate the first end;

a second hole in the shank proximate the second end; and a transverse groove in the first face intersecting the second hole and having:

a base;

a first open end and a second open end; and a first side face and a second side face, wherein:

the transverse groove first side face and second side face converge toward each other from the first open end to the second open end; and the transverse groove first side face and second side face converge toward each other from the first open end to the second open end at an angle (θ) of 15° to 35° over at least 50% of a length of the transverse groove.

19. A vane assembly including the vane arm of claim 18 and further comprising a vane having an airfoil and a shaft protruding from an end of the airfoil, wherein:

the vane shaft extends through the second hole;

the vane shaft has first and second faces respectively abutting the transverse groove first side face and second side face; and a nut holds the vane arm to the shaft.

20. A vane stage comprising a plurality of vane assemblies of claim 19, and further comprising:

a synchronizing ring coupled to the vane arms and having an axis; and for each vane assembly one or more bearings mounting the vane for rotation about an axis of the vane wherein, rotation of the synchronizing ring about its axis rotates the vanes about their respective axes.

* * * * *